219-121 5R
8/18/81 XR 4,284,658

United States Patent [19]

Davis et al.

[11] 4,284,658

[45] Aug. 18, 1981

[54] REGENERATOR SEAL

[75] Inventors: Leonard C. Davis; Theodore Pacala; George R. Sippel, all of Indianapolis, Ind.

[73] Assignee: General Motors Corporation, Detroit, Mich.

[21] Appl. No.: 96,924

[22] Filed: Nov. 23, 1979

[51] Int. Cl.[3] ..... B05D 1/08

[52] U.S. Cl. ..... 427/34; 148/131; 219/121 P; 427/328; 427/330; 427/383.7; 427/423; 432/253; 29/527.4

[58] Field of Search ..... 427/34, 423, 328, 330, 427/383.7; 432/253; 219/121 P; 277/235 A; 165/9; 148/131; 29/527.4

[56] References Cited

U.S. PATENT DOCUMENTS

| | | | |
|---|---|---|---|
| 2,141,518 | 12/1938 | Cox | 432/253 |
| 3,124,492 | 3/1964 | Dewez et al. | 148/131 |
| 3,148,093 | 9/1964 | Williams et al. | 148/131 |
| 3,481,715 | 12/1969 | Whalen et al. | 427/34 |
| 3,646,993 | 3/1972 | Rice et al. | 165/9 |
| 3,666,001 | 5/1972 | Johnson | 165/9 |
| 3,743,008 | 7/1973 | Zeek et al. | 165/9 |
| 3,852,990 | 12/1974 | Sparling | 148/131 |

*Primary Examiner*—John H. Newsome
*Attorney, Agent, or Firm*—J. C. Evans

[57] ABSTRACT

A method for manufacturing a hot side regenerator cross arm seal assembly having a thermally stablilized wear coating with a substantially flat wear surface thereon to seal between low pressure and high pressure passages to and from the hot inboard side of a rotary regenerator matrix includes the steps of forming a flat cross arm substrate member of high nickel alloy steel; fixedly securing the side edges of the substrate member to a holding fixture with a concave surface thereacross to maintain the substrate member to a slightly bent configuration on the fixture surface between the opposite ends of the substrate member to produce prestress therein; applying coating layers on the substrate member including a wear coating of plasma sprayed nickel oxide/calcium flouride material to define a wear surface of slightly concave form across the restrained substrate member between the free ends thereon; and thereafter subjecting the substrate member and the coating thereon to a heat treatment of 1600° F. for sixteen hours to produce heat stabilizing growth in the coating layers on the substrate member and to produce a thermally induced growth stress in the wear surface that substantially equalizes the prestress in the substrate whereby when the cross arm is removed from the fixture surface following the heat treatment step a wear face is formed on the cross arm assembly that will be substantially flat between the ends.

3 Claims, 4 Drawing Figures

REGENERATOR SEAL

The invention herein described was made in the performance of work under a NASA contract funded by the Department of Energy of the United States Government.

This invention relates to cross arm assemblies for sealing between high and low pressure paths through a hot inboard seal assembly and more particularly to a method for manufacturing such cross arm assemblies to form a substantially flat wear face thereon.

One problem in sealing gas flow passages through a rotary regenerator assembly for use in gas turbine engines having turbine engine temperatures in the range of 1400° F. or at temperatures in excess of 1400° F. is that of maintaining a wear face on an inboard seal assembly in a flat disposition with respect to the hot sealed surface of a rotary regenerator matrix disc so as to prevent excessive gas bypass across the cross arm portion of a regenerator seal assembly.

Hot side regenerator seal assemblies have a cross arm connected to rim components of the seal which prevent gas bypass between high and low pressure gas passes in the regenerator assembly. The cross arm is spring biased and pressure loaded against a rotary matrix disc and it must have a wear coating with a flat wear surface that rides against the rotating matrix disc of the regenerator assembly. Otherwise, undesirable bypass of gas can occur from one side of the cross arm seal assembly to the opposite side thereof across the rotating flat face of the regenerator disc. In the past it has been difficult to fabricate cross arms with flat wear surfaces since heat treatment to stabilize coating growth has produced stresses that bend the cross arm substrate.

An object of the present invention is to improve the method of manufacture of hot side regenerator seal assemblies with growth stabilized coating layers on a cross arm substrate member by processing the cross arm portion to prestress a substrate member such that after coating growth in heat treatment and release from the fixture, stresses are relieved to produce a flat wear surface which can be spring biased and pressure loaded into conformity with the rotating regenerator disc of a rotary regenerator system for use in gas turbine engine applications thereby to prevent undesirable gas bypass across the wear face of the cross arm portion of a hot side regerator seal assembly.

Yet another object of the present invention is to improve the method of manufacturing regenerator seal cross arm assemblies wherein a cross arm member is processed by first preforming a substrate of high nickel alloy steel having free end portions thereon and a center segment of variable width between opposite side edges on the substrate member; conditioning the preformed substrate member to remove stresses therefrom so that the member will initially be in a flattened condition; thereafter fixedly securing the substrate member by restraining its side edges to a preformed slightly concavely configured surface on a fixture member to establish a predetermined uniformly, outwardly concavely formed curvature between the free ends of the substrate member to prestress the substrate member; coating the restrained substrate member with layers of material including an outer plasma sprayed coating of nickel oxide/calcium fluoride wear material having a uniform depth across the substrate member; and thereafter subjecting the coated substrate member to a heat treat cycle in the order of 1600° F. for sixteen hours to produce heat stabilized growth of the coating layers on the substrate member while simultaneously mechanically stressing the substrate member to equalize the prestress therein so that when restraint on the substrate member is removed and the cross arm is located in a regenerator seal assembly and operated at turbine inlet temperatures in excess of 1400° F. a relatively undistorted wear face surface will be presented to a flat surface of a rotary regenerator matrix disc to prevent excessive gas bypass across the cross arm assembly during turbine engine operation.

Further objects and advantages of the present invention will be apparent from the following description, reference being had to the accompanying drawings wherein a preferred embodiment of the present invention is clearly shown.

Figure 1:
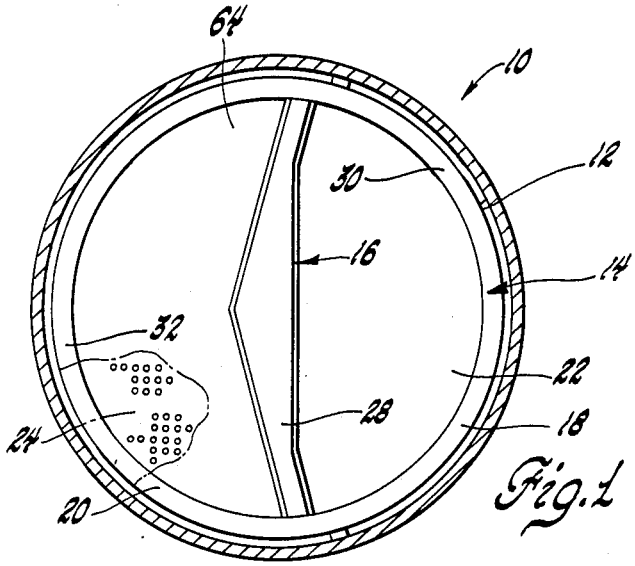
FIG. 1 is an end elevational view of a regenerator seal cross arm assembly manufactured by the method of the present invention.

Referring now to the drawing, in FIG. 1 a gas turbine engine block 10 is illustrated having a seal support platform 12 therein in which is supportingly received an inboard or hot gas side seal assembly 14 for use in gas turbine engine regenerator systems. The seal assembly 14 is, more specifically, the type set forth in U.S. Pat. No. 3,542,122, issued Nov. 24, 1970, to Bracken, Jr., for "Regenerator Seal". Such seals include a cross arm 16 interconnected at opposite ends thereof to generally semicircularly configured rim portions 18, 20. The rim 20 constitutes a low pressure rim seal which, together with the cross arm 16, seals the peripheral extent of a low pressure opening 64 which directs low pressure exhaust gas to the hot side of a rotary regenerator matrix disc 24 which has a flat surface 26 thereof located in sealing engagement with the exposed surfaces of the seal assembly 14 which are shown in FIG. 1.

More particularly, the cross arm 16 has a wear face 28 thereon and the rim portions 18 and 20 have wear faces 30 and 32 thereon. In such arrangements, a spring seal system is interposed between the seal support platform 12 and a backside portion of the cross arm and low and high pressure rim portions 20, 18. Examples of such biasing systems are shown in U.S. Pat. No. 3,542,122, issued Nov. 24, 1972, to Bracken Jr. In accordance with the present invention, the cross arm arm 16 of the above illustrated seal assembly 14 is processed to eliminate the problem of wear face warpage produced during heretofore practiced plasma spray processing methods. By practicing the present invention it has been found that a multiple coating can be imposed on one side of a metallic substrate of a cross arm seal assembly so as to prevent end-to-end warpage of a wear face surface following a heat treatment process to growth stabilize the plasma spray coatings for subsequent long term durability in gas turbine engine operation wherein the hot side matrix face can reach temperatures in the order of 1000° F. to 1400° F.

Figure 2:
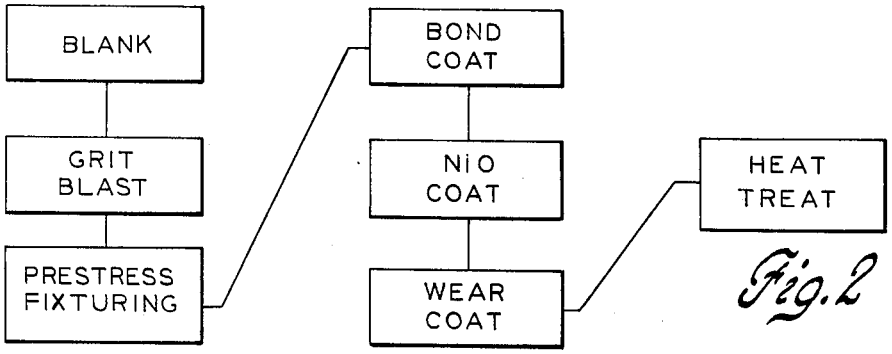
FIG. 2 is a block diagram of a process sequence utilized in practicising the present invention.
Figure 4:
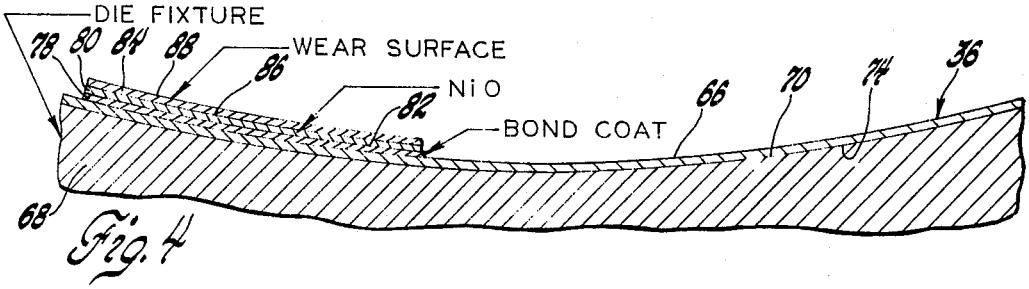
FIG. 4 is an enlarged, fragmentary sectional view taken along the line 4—4 of FIG. 3.

More particularly, in practicing the present invention, a process is utilized having the basic steps set forth in the block diagrams of FIG. 2. The first step includes that of forming a cross arm blank 36 having opposite free ends thereon illustrated as being arcuate end segments 38, 40 each having a locating tab 42, 44 thereon, respectively, for locating the cross arm 16 at an indexed relationship with respect to the seal support platform 12. The cross arm blank 36 defines a metallic substrate between the arcuate segments 38 and 40 with a first arm portion 46 extending along one radial line from an arm center point 48 and a second arm portion 50 extending along a second radial line from center point 48. Each of arm portions 46, 50 diverge from the arcuate segments 38 and 40 along opposed edges 52, 54 on the arm portion 46 and opposed edges 56, 58 on the arm portion 50. Thus, the arm portions have a variable width from their point of connection at the arcuate segments 38, 40 to a center segment 60 having an apex 62 thereon. Thus, the substrate in the blank 36 has a complex geometry and shape between the opposite ends thereof. In such arrangements, during the processing of a cross arm member for use in an inboard assembly 14 it is necessary to thermally stabilize various bond and wear surface coatings that are plasma spray coated on the substrate defined by the cross arm blank 36. Heretofore, it has been found that such heat stabilization can cause a bend to occur in the length of the cross arm between the arcuate segments 38, 40. Accordingly, the present invention includes a specific processing sequence that is aimed at eliminating such bends so that the resultant cross arm assembly will have a relatively flat wear surface thereon at the wear face 28 so that it will uniformly seal across the width of a matrix disc 24 on the hot surface thereof to seal between the low pressure opening 64 and a high pressure inlet air opening 22 formed between the cross arm 16 and the high pressure rim 18. The process sequence includes a first surface preparation wherein the cross arm blank 36 is degreased with a suitable solvent such as perchlorethylene or is cleaned by a cheese cloth dampened with acetone. Surface preparation is followed by blasting both surfaces of the cross arm blank 36 with sixty grit aluminum oxide particles directed against the opposite flat surfaces of the cross arm blank 36 under an application pressure of 60 psi with the grit blasting applicator being located six inches from the cross arm blank 36. Such grit blasting will equally stress the blank 36 at the start of the process sequence of the present invention. Following grit blasting, all loose particles are removed from the cross arm by use of compressed air or by cleaning the part with cheese cloth dampened with acetone. Thereafter, the clean equally stressed cross arm blank 36 is mechanically restrained to produce a controlled prestress therein. The prestress application uses holding fixture 68 preferably prefabricated from a block of Hastelloy-X material to have a dished surface 70 therein. In one process sequence the dished surface 70 is bent along an arc and has a maximum depth of 125 mils. The cross arm blank 36 is conformed to the dished surface 70 as shown in FIG. 4 in exaggerated form with center segment 60 located at the maximum depth of surface 70. Then it is restrained with respect to the dished surface 70 by directly fixing the opposed edges 52, 54 of arm portion 46 to the holding fixture 68 and the opposed edges 56, 58 of the arm portion 50 to the holding fixture 68 by suitable means such as spot welds 72 located at spaced points along each of the aforesaid edges so that the full planar extent of the inner surface 74 of the cross arm blank 36 will form-fit to the dished surface 70. The amount of curvature in the dished surface 70 is preselected to conform to an amount of deflection which will pre-stress blank 36 to a level and of opposite sense to thermally induced stress that is produced in the blank 36 during a subsequent heat treatment step. The amount of deflection by the dished surface places a pre-stress in the blank 36 which is maintained by the spot welds 72.

In the illustrated arrangement, the exposed surface 66 of the restrained cross arm blank 36 is masked to define the outer perimeter 76 of an area on the seal cross arm blank 36 that will be coated with desired material coating layers.

Figure 3:
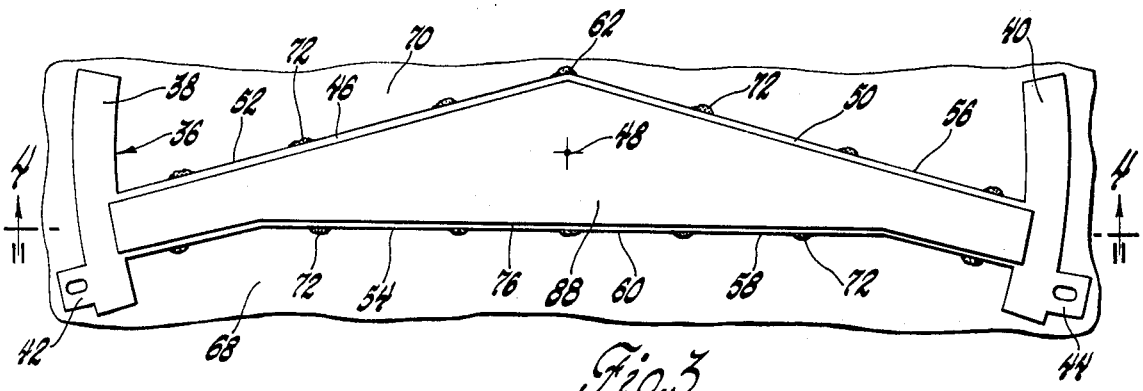
FIG. 3 is a top elevational view of a regenerator cross arm on a process holding fixture.

As shown in FIG. 2, once the part has been fixtured and masked the parts are preheated to 175° F. to 200° F. (79.4° C. to 93.3° C.). Then a bond coat 78 is plasma spray deposited on the exposed surface 66. One suitable bond coat is a nickel chrome bond coating such as Metco 443 which is applied to a uniform thickness of from four to six mils completely across the area bounded by the perimeter 76 shown in FIG. 3. The bond coat plasma spray should be applied at an impingement angle of 90°, plus or minus 15°, and at a distance of from four to five inches from the part to be sprayed. In one working embodiment, the spray parameters included the use of an SG1B gun system having a nozzle S1-3-F and an electrode S1-3-R, all manufactured by Plasmadyne Corp. The carrier gas is argon applied at a rate of 65 cubic feet per hour and helium at a rate of 15 cubic feet per hour. The spray gun system is electrically connected to a source of power of 500 amps. at 45 volts.

A 1000 A powder feed of Plasmadyne Corporation is used to apply the nickel/chrome bond coating material. The feed gear has thirty teeth and it is set at a dial setting of 30. An argon carrier gas for the powder feed is applied at a rate of fifteen cubic feet per hour at an external powder feed port.

Following application of the bond coat, the process includes plasma spray application of a barrier coating 80 to cover the exposed bond coat surface 82. The barrier coat is preferably 100% nickel oxide which is applied uniformly to a depth of 10 mils across the bond coat surface 82. The barrier coat 80 is selected to have a chemistry to prevent migration of contaminate materials between a bond coat and an outer wear coat.

The spray coating apparatus and the spray parameters for application of the barrier coat are those used to apply the bond coat 78 as stated above.

In accordance with the present invention, a finish coat or seal wear coat layer 84 is plasma sprayed onto an outer surface 86 of the barrier coat 80. Preferably, the wear coat is a composition of nickel oxide (NiO) and calcium flouride ($CaF_2$) in the range of 60%–85% NiO and 15%–40% $CaF_2$. The above powders are measured by weight percent and are blended in a twin shell blender or equivalent until they are thoroughly mixed and then they are applied with plasma spray apparatus having the above stated parameters.

In the illustrated arrangement, the wear coat layer 84 is applied to a uniform depth of 30 mils across the outer surface 86 of the previously applied barrier coat 80.

In order to growth stabilize the spray coated nickel oxide and calcium flouride coating to prevent thermal growth distortion therein when the seal cross arm 16 is used in an operating gas turbine environment, it is necessary to subject the layers of material on the metallic substrate material of the cross arm blank 36 to a heat treatment cycle wherein the part is heated in air to a temperature in the range of 1600° F. for a time period in the order of sixteen hours. During this heat treatment step, it has been found necessary to cover the outer surface 88 of the wear face with a thermal insulation blanket to eliminate overheating of the coat due to excess radiation from furnace elements which are in a line of sight relationship to the surface coatings on the metal substrate defined by the cross arm blank 36.

Heretofore, it has been found that such thermal heat treatment steps, applied to an unrestrained metal substrate, caused the cross arm to bend between the ends thereof to a degree where a wear surface thereon was not sufficiently flat to conform to the hot inboard surface of a rotary matrix disc during gas turbine engine operation. As a result, undesired gas bypass occurred thereacross which caused a loss of efficiency.

By practicing the specific sequence of steps discussed above and outlined in FIG. 2, the heat treatment stabilized the wear surface coating and produced a stress in blank 36 which balanced that produced by the prestress fixturing step.

The spot welds 72 are removed and the resultant cross arm 16 is removed from the holding block 68 in a substantially unstressed condition with a substantially flat wear coat surface 28. The arm 16 can be operated at equilibrium conditions of gas turbine engine operation and in sealing relationship to the flat hot inside surface of the rotary matrix disc 24 and yet retain a substantially flat wear face 28 that will be undistorted between the arcuate segments 38, 40 when indexed with respect to the seal support platform 12.

Cross arms processed by the present invention have been measured to have a flatness measured end-to-end of the cross arms in the order of ten to fifteen mils in a slightly convex mode which is considered, for purposes of a running seal in a gas turbine engine with spring back-up biasing systems, to be sufficiently flat to adequately seal between the pressure conditions of gas flow through the low pressure opening 64 and the high pressure opening 22.

While the embodiments of the present invention, as herein disclosed, constitute a preferred form, it is to be understood that other forms might be adopted.

The embodiments of the invention in which an exclusive property or privilege is claimed is defined as follows:

1. A method for manufacturing a seal cross arm assembly for a rotary heat exchange regenerator comprising the steps of forming a cross arm substrate member having free opposite ends thereon joined by a center segment having side edges between the opposite ends, equally stressing the member to a flattened condition, fixedly securing the substrate member to a holding fixture to maintain a concave bend between the opposite ends at the outer surface of the substrate member to maintain a controlled prestress therein during subsequent processing steps, bond coating the outer surface to form an oxidation resistant surface thereon, plasma spray coating a layer of nickel oxide on the bond coating to prevent contamination thereof by subsequently applied wear surface material, plasma spray depositing a nickel oxide/calcium flouride wear coating to a uniform depth across the plasma spray coating of nickel oxide for defining a wear surface of concave form, and thereafter heat treating the prestressed and coated substrate member to produce a thermally induced growth stress in the wear coating that substantially equalizes the prestress in the substrate member thereby to produce a resultant flat wear surface on the cross arm assembly when the substrate member is removed from the holding fixture and placed in a gas turbine engine regenerator and operated under temperature conditions in the order of 1400° F.

2. A method for manufacturing a seal cross arm assembly for a rotary heat exchange regenerator comprising the steps of forming a cross arm substrate member having free opposite ends thereon joined by a center segment having side edges thereon, grit blasting both the top and bottom surfaces of the member to clean the surfaces thereon and to equally stress the member to a flattened condition, fixedly securing the side edges of the substrate member to a holding fixture so as to restrain the substrate member thereagainst and to maintain a concave bend between the opposite ends at the outer surface of the substrate member during subsequent processing steps, bond coating the outer surface to form an oxidation resistant surface thereon, plasma spray coating a layer of nickel oxide on the bond coating to prevent contamination thereof by subsequently applied wear surface material, plasma spray depositing a nickel oxide/calcium flouride wear coating to a uniform depth across the plasma spray coating of nickel oxide for defining a wear surface of concave form, and thereafter heat treating the prestressed and coated substrate member to produce a thermally induced growth stress in the wear coating that substantially equalizes the prestress in the substrate member thereby to produce a resultant flat wear surface on the cross arm assembly when the substrate member is removed from the holding fixture and placed in a heat exchange regenerator and operated under temperature conditions in the order of 1400° F.

3. A method for manufacturing a seal cross arm assembly for a rotary heat exchange regenerator comprising the steps of forming a flat cross arm substrate member of nickel alloy steel having free opposite ends thereon joined by a center segment having side edges thereon defining a variable width platform between the opposite ends, grit blasting both the top and bottom surfaces of the member to clean the surfaces thereon and to equally stress the member to a flattened condition, fixedly securing the substrate member to a holding fixture so as to restrain the substrate member thereagainst and to maintain a concave bend between the opposite ends at the outer surface of the substrate member during subsequent processing steps, bond coating the outer surface to form an oxidation resistant surface thereon, plasma spray coating a layer of nickel oxide on the bond coating to prevent contamination thereof by subsequently applied wear surface material, plasma spray depositing a nickel oxide/calcium flouride wear coating to a uniform depth across the plasma spray coating of nickel oxide for defining a wear surface of concave form, and thereafter heat treating the prestressed and coated substrate member to produce a thermally induced growth stress in the wear coating that substantially equalizes the prestress in the substrate member thereby to produce a resultant flat wear surface on the cross arm assembly when the substrate member is removed from the holding fixture and placed in a rotary heat exchange regenerator and operated under temperature conditions in the order of 1400° F.

* * * * *